United States Patent [19]

Bühler et al.

[11] Patent Number: 4,588,368

[45] Date of Patent: May 13, 1986

[54] APPARATUS FOR PRODUCING MOLDED ARTICLES FROM A POURABLE COMPOUND

[75] Inventors: Eugen Bühler, Schleifweg 3, D-8871 Burtenbach; Klaus Strobel, Selb; Karl Schwarzmeier, Selb-Oberweissenbach, all of Fed. Rep. of Germany

[73] Assignees: Eugen Bühler, Burtenbach; Hutschenreuther AG, Selb, both of Fed. Rep. of Germany

[21] Appl. No.: 608,501

[22] Filed: May 9, 1984

Related U.S. Application Data

[63] Continuation of Ser. No. 397,067, Jul. 12, 1982, abandoned.

[30] Foreign Application Priority Data

Jul. 17, 1981 [DE] Fed. Rep. of Germany ..... 3128348

[51] Int. Cl.[4] ..... B28B 3/02; B28B 13/02

[52] U.S. Cl. ..... 425/546; 264/102; 425/356; 425/389; 425/405 H; 425/566; 425/DIG. 19

[58] Field of Search ..... 425/356, 361, 405 R, 425/405 A, 389, 406, 107, 564, DIG. 44, DIG. 60, DIG. 48, 546, 566, DIG. 19; 264/102

[56] References Cited

U.S. PATENT DOCUMENTS

| | | | |
|---|---|---|---|
| 1,810,078 | 6/1931 | Housman | 425/361 |
| 2,666,951 | 1/1954 | Grove et al. | 425/DIG. 48 |
| 3,010,156 | 11/1961 | Smith | 425/564 X |
| 3,461,504 | 8/1969 | Becker et al. | 425/DIG. 48 |
| 3,520,961 | 7/1970 | Suda et al. | 264/71 |
| 3,664,799 | 5/1972 | Wallick et al. | 425/405 H X |
| 3,868,201 | 2/1975 | Jacobson et al. | 425/78 |
| 4,043,724 | 8/1977 | Schubart | 425/361 |
| 4,128,375 | 12/1978 | Schubart | 425/405 H |
| 4,140,470 | 2/1979 | Pasch | 425/405 R |
| 4,306,852 | 12/1981 | Mateev et al. | 425/564 X |
| 4,473,526 | 9/1984 | Bühler et al. | 264/517 |
| 4,482,515 | 11/1984 | Bühler et al. | 425/566 |

FOREIGN PATENT DOCUMENTS

| | | |
|---|---|---|
| 604691 | 12/1934 | Fed. Rep. of Germany . |
| 2657993 | 5/1978 | Fed. Rep. of Germany . |
| 53-7937 | 3/1978 | Japan . |
| 1007631 | 10/1965 | United Kingdom . |
| 1012589 | 12/1965 | United Kingdom . |
| 1162672 | 8/1969 | United Kingdom . |
| 1443350 | 7/1976 | United Kingdom . |
| 464385 | 9/1975 | U.S.S.R. . |

*Primary Examiner*—Jay H. Woo
*Assistant Examiner*—James C. Housel
*Attorney, Agent, or Firm*—Toren, McGeady, Stanger, Goldberg & Kiel

[57] ABSTRACT

In an apparatus for producing molded articles from a pourable compound, such as an oxide-ceramic compound, for example a porcelain compound, an injection chamber is formed between an isostatic compression molding tool and an injection chamber. A suction opening is connected to the injection chamber. The pourable compound is supplied through an inlet opening. A fluidizing air inlet line is positioned in the compound inlet opening and it is movable relative to the inlet opening so that it can be placed in an open or closed position for admitting or blocking flow of the compound into the injection chamber.

9 Claims, 3 Drawing Figures

APPARATUS FOR PRODUCING MOLDED ARTICLES FROM A POURABLE COMPOUND

This is a continuation of application Ser. No. 397,067, filed July 12, 1982.

SUMMARY OF THE INVENTION

The present invention is directed to apparatus for producing molded articles from a pourable compound, such as an oxide-ceramic compound, for example, a porcelain compound, including an isostatic compression tool and an injection head arranged to define an injection chamber between them, at least one air suction opening and at least one compound inlet opening connected to the injection chamber and a fluidizing air in inlet line having its outlet in the region of the compound inlet opening. Such an apparatus is disclosed in U.S. Patent Application Ser. No. 224,037 filed Jan. 12, 1981 by the applicants in this application and is assigned to the same assignee as is this application, now U.S. Pat. No. 4,473,526.

The apparatus disclosed in the application operates as follows:

A negative pressure or suction is applied to the injection chamber and the negative pressure causes the compound to be drawn into the chamber from the compound inlet opening in a fluidized form. Fluidization is effected by a flow of fluidizing air passing into the inflowing compound at the location of the compound inlet opening. Fluidization ensures that the pourable compound is distributed as uniformly as possible over the entire injection chamber so that, after the injection chamber has been filled, the grain distribution of the pourable compound is essentially the same throughout the injection chamber. Subsequently, the compound within the chamber is compression molded. Only a preliminary compression is carried out in the injection chamber with the final compression molding being effected between the isostatic compression tool and a top force used in place of the injection head.

In this known apparatus, there is no closure for the compound inlet opening and, as a result, the inlet opening remains open when the injection head is lifted off so that the molded article can be removed. Because of this arrangement, difficulties arise when the compound inlet opening is connected to a vessel holding more compound than is required for each injection cycle. Further, in the known apparatus it is not easy to accommodate a closure for the compound inlet opening, since such a closure must be positioned at the same location with the fluidizing air inlet line. Accordingly, there is no room for a closing member and for its actuating members.

Therefore, the primary object of the present invention is to provide an improvement of the above-described apparatus so that, despite the proximity of the compound inlet opening and the outlet from the fluidizing air inlet line, it is possible to close the inlet opening. With such a closure, it is possible to store, in a compound supply vessel located upstream from the compound inlet opening, an amount of the compound for carrying out successive injection cycles. With this arrangement it is possible to avoid any flow of the compound out of its inlet opening when the injection head has been moved into position for removing the molded article.

In accordance with the present invention, a part of the fluidizing air inlet line is constructed as a closure for the compound inlet opening and is adjustable between an open position and a closed position.

A particularly simple closure is provided when the inlet opening is formed by the end of a duct with the adjustable portion of the fluidizing air inlet line located within the duct adjacent the opening so that the combination of the duct and the air inlet line form an annular passageway.

Such a closure is provided when the duct tapers inwardly toward the compound inlet opening and the adjustable portion of the air inlet line need only be adjustable in the axial direction between the open position and the closed position, so that, in the closed position, the adjustable part of the air inlet line is disposed in contact with the narrow end of the duct.

In one embodiment, the adjustable part of the fluidizing air inlet line can be formed by an air supply line. In another embodiment, the adjustable part of the fluidizing air inlet line can be formed by a sheathing tube or a sheathing ring laterally enclosing the air supply line.

The adjustable part of the fluidizing air inlet line can be moved by a power device controlled in accordance with the operating cycle of the apparatus.

As indicated in the patent application mentioned above, the injection head is constructed for the formation of a preformed article which is subsequently subjected to a final compression molding between the isostatic compression molding tool and a top force used in place of the injection head. Such an embodiment has the advantage that, in constructing the injection head, no attention must be paid to the high load bearing capacity of the injection head during the final isostatic compression molding, and also no particular attention need be paid to avoiding marks in the molded article, that is, such marks as can be expected at the location of the compound inlet opening, the fluidizing air inlet location and the suction location, since these marks are eliminated in the final compression molding between the isostatic compression molding tool and the top force used in place of the injection head. In the case of molded articles having wall portions which are relatively high and extend approximately parallel to the mold opening direction there is, in particular, the problem that, when the injection head is raised, the preformed article remaining in the isostatic compression molding tool is not supported from one side when the injection head is removed until the top force replaces the injection head. In such a situation the wall of the preformed article may collapse. To avoid such a possibility, the present invention relates to measures for precompressing the molded article formed by filling the compound into the injection chamber and the injection head includes precompressing means for precompressing the molded article.

In a preferred embodiment, the injection head is equipped with a basic structural unit capable of moving between a closed position and removal position. The structural unit has a closing edge for effecting sealing contact with an opposite edge on the isostatic compression molding tool. A precompression force or die is positioned in the basic structural unit and this precompression member, in the closed position of the basic structural unit, can be adjusted between a mold filling position and a precompression position. In such an arrangement, however, precompression of the sides of the molded articles being formed and extending in the opening-closing direction of the mold becomes more difficult as the sides become more steep, that is, the more the sides approach being parallel to the opening-closing direction of the mold.

To facilitate precompression even in the presence of very steep sides, which precompression ensures that the precompressed molded article does not collapse when the injection head is lifted from the isostatic compression molding tool, in a particularly interesting development of the invention, it is proposed that the injection head has a molding surface covered by a precompression membrane with the molding surface defining a portion of the injection chamber. A pressure medium connection is located in the space between the precompression membrane and the molding surface. Accordingly, the following explanation is necessary:

Initially, one might consider that it would be possible to effect the precompression using the compression membrane which is a part of the isostatic compression mold, by applying a pressure to the compression membrane and pressing the filled-in compound against the molding surfaces of the injection head by means of the compression membrane. Such an operation can not be performed, because the preformed article remains in the isostatic compression mold when the injection head is lifted, that is, the pressure behind the compression membrane of the isostatic compression tool must be relieved and a gap would be created between the preformed article and the compression membrane. Such a gap could lead to the collapse of the preformed article and, in addition, it could lead to the destruction of the preformed article when the top force is subsequently moved against the isostatic compression tool.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
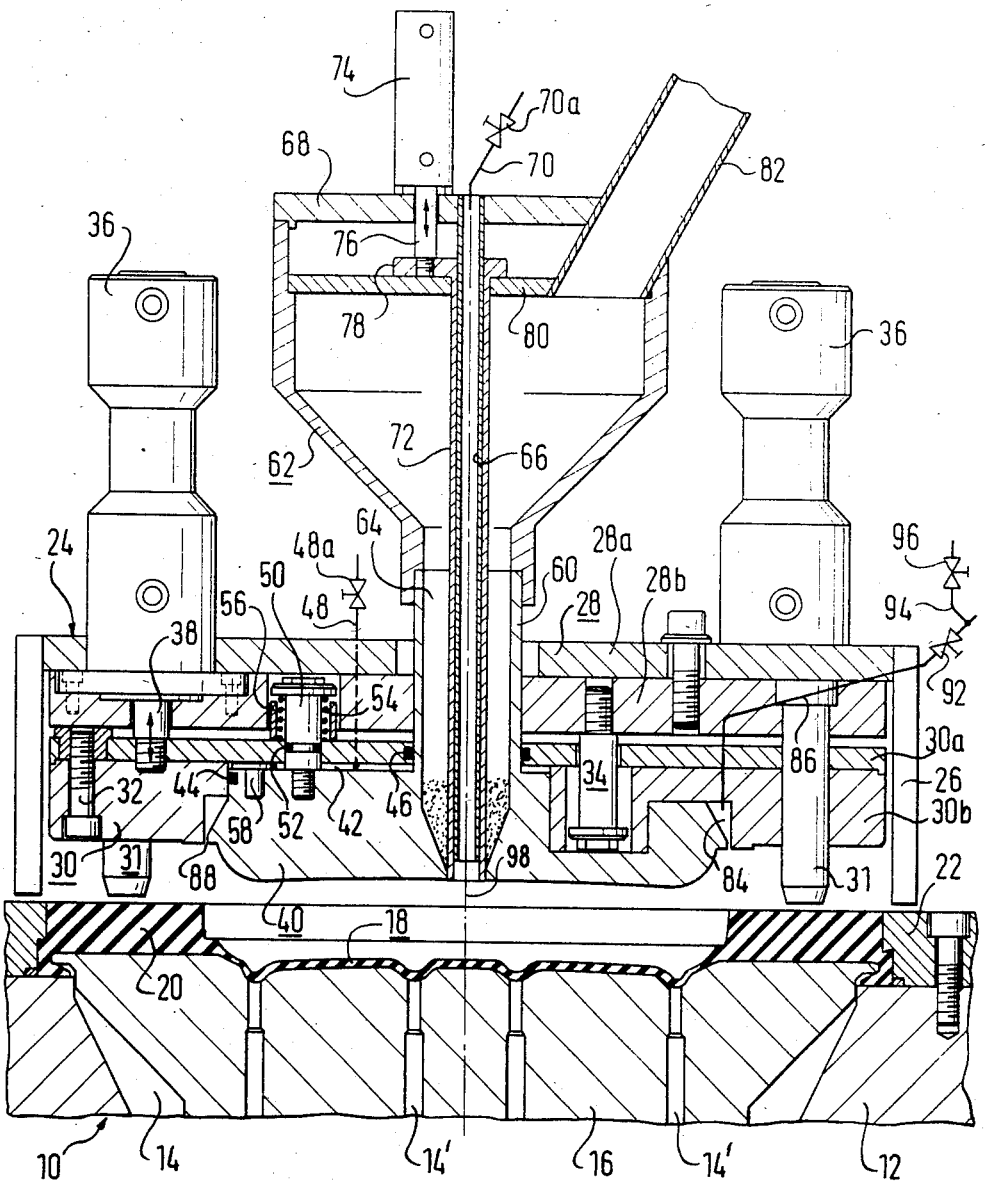
FIG. 1 is a vertical sectional view of one embodiment of an apparatus incorporating the present invention, with the injection head in the raised position.
Figure 2:
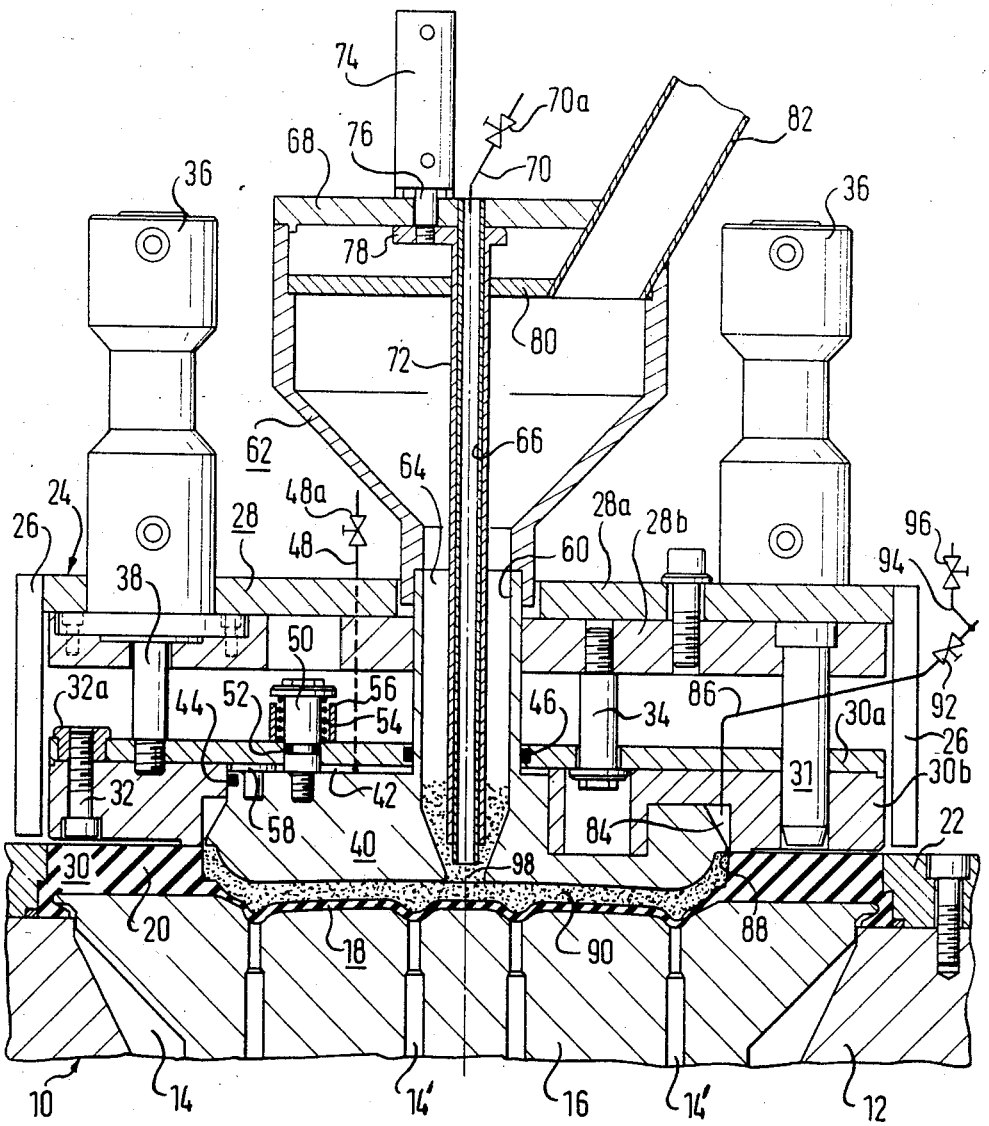
FIG. 2 is a sectional view similar to that shown in FIG. 1, however, with the injection head disposed in the injection position.

In FIGS. 1 and 2, an isostatic compression molding tool 10 is indicated generally, the isostatic compression molding tool includes a pressure cup 12 forming a pressure chamber 14. Support plate 16 is positioned in the pressure chamber 14 and a compression membrane 18 extends over the upper surface of the support plate. Channels 14' extend through the support plate 16 from the pressure chamber 14 to the back or lower surface of the compression membrane 18. An edge 20 on the compression membrane 18 provides a seal with the injection head, to be described, and also a seal for the pressure chamber 14. A fixing ring 22 fastens the edge 20 to the edge of the pressure cup 12.

An injection head 24 is shown positioned above the molding tool 10. Injection head 24 includes an injection head frame 28 formed by plates **28*a*, 28*b* bolted together and supported by brackets 26. A basic structural unit 30 of the injection head is located below and is guided to the injection frame 28 by guide pins 31. Basic structural unit 30 is made up of two plates 30*a*, 30*b* held together by bolts 32. The travel of the basic structural unit 30 is limited in the upward direction by a nut 32*a* threaded onto the upper end of the bolt 32 and in the downward direction by tension bolts 34 fastened to the head frame 28. Power devices 36 each having a piston rod 38 are mounted on the frame 28 and are connected to the basic structural unit 30. A precompression die 40 is located centrally and on the lower side of the basic structural unit 30 and it is guided for movement in the vertical direction. A pressure space 42 is located between the plate 30*a* of the basic structural unit 30 and the precompression die 40. Pressure space 42 is sealed by the sealing rings 44, 46. A pressure fluid line 48 is connected to the pressure space 42. Returning and travel-limiting bolts 50 are secured at their lower ends into the precompression die 40 and extend upwardly through the plate 30*a*, where a seal is effected by sealing ring 42, into the plate 286 where the bolts are pretensioned by helical compression springs 54. Downward travel of the bolts 50 is limited by annular sleeves 56 encircling the bolts 50 in the region of the plate 28*b*. The upper positon of the precompression die 40 under the biasing action of the helical compression springs 54 is limited by spacer members 58. A filling tube 60 is formed by and extends upwardly from the upper surface of the precompression die 40. The filling tube 60 is centrally positioned in the precompression die 40. A molding compound vessel 62 is supported on the upper end of filling tube 60. Filling tube 60 forms a molding compound supply duct 64. Arranged centrally within the molding compound supply duct 64 is a fluidizing air inlet tube 66 supported at its upper end by a cover 68 of the compound supply vessel 62. The air inlet tube 66 is connected at its upper end to a fluidizing air supply line 70. From its lower end to adjacent its upper end, the fluidizing air inlet tube 66 is laterally enclosed in a sheathing tube 72 and the sheathing tube is axially movable relative to the air inlet tube 66. A power device 74 is mounted on the cover 68 and it has a downwardly extending pistion rod 76 connected to a flange formed on the upper end of the sheathing tube 72. By means of the power device 74, the sheathing tube can be moved in the axial direction along the fluidizing air inlet tube 66**.

The compound supply vessel 62 has an intermediate cover 80 positioned downwardly from the cover 68 and a compound supply tube 82 is connected to the lower cover 80.

An annular suction chamber 84 extends circumferentially around the precompression die 40 and is limited radially outwardly by the plate **30*b*. A suction line 86 is connected to the annular suction chamber 84. The annular suction chamber 84 communicates with the injection chamber 90 through a suction gap 88 formed between the plate 30*b* and the compression die 40. The injection chamber 90 is formed on the upper side by the precompression die 40 and on the lower side by the isostatic compression member 18. Suction line 86 can be closed by a valve 92 and it is also connected to a secondary air line 94 containing a valve 96. In FIG. 1, the basic structural unit 30 is located in its uppermost position and the precompression die 40 is in its uppermost position relative to the basic structural unit 30. In this position, a molded article formed previously can be removed when the injection head 30 is moved relative to the isostatic compression molding tool 10**.

To commence a new work cycle, basic structural unit 30 is lowered by the power device 36 until the plate 30*b*, as illustrated in FIG. 2, rests on the edge 20 of the compression membrane 18. The precompression die 40 is still in its uppermost position relative to the basic structural unit 30. Initially, the sheathing tube 72 is in the position shown in FIG. 1 relative to the precompression die 40 with the lower end of the sheathing tube forming a closure of the opening 98 from the molding compound supply duct 64. By adjusting valve 92 a negative pressure is established in the suction chamber 84 and, through the gap 88, the negative pressure acts in the injection chamber 90. With the injection chamber under a negative pressure, sheathing tube 72 is lifted by the power device 74, relative to the fluidizing air inlet tube 66 with the sheathing tube moved into the position relative to the precompression die 40 illustrated in FIG. 2. Due to the upward movement of the sheathing tube 72 over the air inlet tube 66, the compound inlet opening 98 is opened. The pourable molding compound can be drawn from the supply vessel 62 into the injection chamber 90. Simultaneously, fluidizing air is supplied through the fluidizing air inlet tube 66 by opening the valve 70*a*. As a result, the pourable compound is fluidized as it moves into the injection chamber 90 and it is uniformly distributed throughout the chamber. At the outset, the degree of suction acting through the gap 88 can be limited by supplying secondary air through the secondary air line 94 and its valve 96. Therefore, at the commencement of the filling operation, the molding compound particles are propelled at a relatively slow impact speed toward the gap 88 and blockages do not occur at the gap which could impair the suction effect and the filling operation. During the initial part of the filling operation, the larger molding compound particles, for example, particles of spray-dried porcelain compound granulate, are not destroyed when they impinge the air of the gap 88, since such destruction could lead to interruption of the suction effect. With respect to details, reference is made to the patent application mentioned above.

As soon as the injection chamber 90 is completely filled with molding compound, pressurized fluid is supplied to the pressure space or chamber 42 by opening the valve 48*a* while the negative pressure in the injection chamber 90 is maintained, whereby the precompression die 40 is pressed downwardly against the biasing effect of the helical compression springs 54. With the downward movement of the precompression die 40, the size of the injection chamber is reduced and the preformed article is precompressed. At this point, the suction effect can be discontinued by closing the valve 92. Sheathing tube 72 is returned to its lower position, as shown in FIG. 1, providing a closure of the compound inlet opening 98. Further flow of molding compound from the compound supply vessel 62 into the injection chamber 90 is stopped. Basic structure unit 30 is raised by actuating the power devices 36 returning the unit to the position displayed in FIG. 1. Assuming that the isostatic compression molding tool 10 is arranged for lateral movement relative to the injection head 24, for example, on a turntable, the isostatic compression molding tool with the preformed article is moved under a top force, not shown, which is under the influence of another press and the final compression molding of the preformed article is effected under high pressure utilizing the compression membrane 18.

Figure 3:
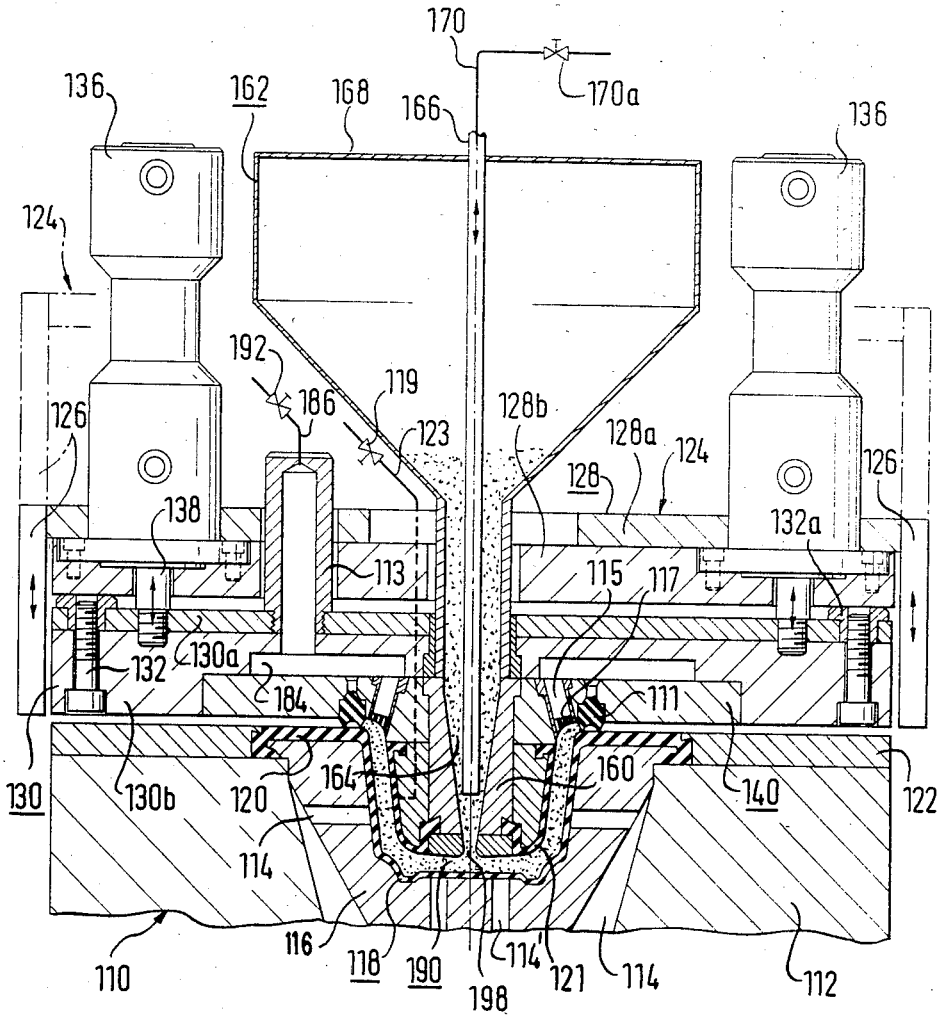
FIG. 3 is a sectional view, similar to FIGS. 1 and 2, illustrating another embodiment of the present invention with the injection head located in the injection position.

In the embodiment shown in FIG. 3, similar parts are given the same reference numerals as in the embodiment shown in FIGS. 1 and 2, however, the reference numerals are increased by 100.

In the embodiment in FIG. 3, contrary to that in FIGS. 1 and 2, precompression die 140 is fixed to the basic structural unit 130. Injection head 124 can, in its entirety, be vertically displaced into the position illustrated by dash-dot lines. The vertical movement is effected by the brackets 126. In FIG. 3, the injection head 124 is in the injection position with a lip seal 111 resting on edge 120 of compression membrane 118. Basic structural unit 130 assumes its uppermost position relative to the injection head frame 128. A suction action is established through a suction tube 113, a chamber 184, and bores 115 closed by nozzles 117. Fluidizing air line 166 is a simple tube without a sheathing tube. The tube 166 is axially movable between the open and closed positions of the compound inlet opening 198. In the position shown in FIG. 3, negative pressure is initially applied via valve 192 so that it acts on the injection chamber 190. Subsequently, the fluidizing air inlet tube 166 is moved from the closed position into the open position shown in FIG. 3 so that the suction action or negative pressure within the injection chamber 190 is capable of drawing the molding compound through the compound inlet opening 198. The negative pressure conditions are the same as those described relative to the apparatus shown in FIGS. 1 and 2. As soon as the injection chamber 190 is filled with molding compound, the entire basic structural unit 130 with the precompression die 140 is lowered by actuating the power device 136 causing the lip seal to be deformed while the negative pressure is maintained. As a result, a certain precompression of the molded article created by filling the injection chamber 190 is effected, in particular there is a precompression in the region of the upper edge of the article. Simultaneously or subsequently, pressurized fluid is supplied to the back side of a precompression membrane 121 via a pressure fluid line 123 and valve 119. The precompression membrane covers a part of the molding surface of the precompression die 140. As a result, the preformed article is precompressed, particularly in the region of its side extending essentially parallel to the axis of the molding apparatus. As soon as the precompression step is completed, the basic structural unit can be lifted by the power device 136 after the fluidizing air inlet tube has been moved downwardly effecting the closure of the molding compound supply duct 164. Subsequently, the entire injection head 124 can be raised into the position illustrated in dash-dot lines. The isostatic compression molding tool 110 can be moved into alignment below a top force. After the top force has been lowered, pressure is applied to the isostatic compression member 118 to complete final compression molding.

While specific embodiments of the invention have been shown and described in detail to illustrate the application of the inventive principles, it will be understood that the invention may be embodied otherwise without departing from such principles.

We claim:

1. Mold and press unit for producing molded articles from a dry, flowable porcelain substance, comprising a first mold and press unit (110) and a second mold and press unit (130), (a) said first mold press unit (110) and said second mold press unit (130) define a mold and press space (190) therebetween, said mold and press space having a circumferential edge encircling said mold and press space;

(b) said first mold press unit comprises a compression membrane (118) forming a part of said mold and press space and said compression membrane has an edge (120) extending radially outwardly from said mold and press space;

(c) said compression membrane (118) having one surface forming a part of said mold and press space and an opposite second surface, and said first mold and press unit (110) includes a support plate (116) supporting the opposite second surface of said compression membrane;

(d) said support plate (116) having compressed medium channels (114') opening to the second surface of said compression membrane and a pressure chamber (114) in communication with the second surface of said compression membrane (118) through said channels so that pressure can be built up against the second surface;

(e) said second mold and press unit (130) includes a precompression die (140) located on the opposite side of said mold and press space from said compression membrane (118) and forming a part of said mold and press space;

(f) a first fluid-actuated power means (136) in communication with said precompression die (140) for pressing said die against said edge (120) of said compression membrane (118);

(g) said precompression die (140) having a supply duct (164) therethrough centrally arranged relative to said mold and press space for supplying a flowable porcelain substance into said mold and press space, said supply duct secured to said precompression die;

(h) said second mold and press unit (130) includes suction means (117, 115, 184, 186) extending around the circumferential edge of said mold and press space and annularly around the space outwardly from said supply duct (198);

(i) an annular precompression membrane (121) located on the surface of said precompression die (140) facing said mold and press space, said precompression membrane (121) extending annularly around said supply duct (164) and extending outwardly therefrom toward the inlets (117) of said suction means (117, 115, 184, 186) into said mold and press space;

(j) a pressure fluid line (123) is connected to the space between said precompression die (140) and said precompression membrane (121);

(k) control means are provided for:

(aa) effecting contact pressure of said precompression die (140) on said edge (120) of said precompression membrane (118) by activating said first fluid actuating power means (136);

(bb) subsequently applying a vacuum at said suction means (117, 115, 184, 186) for permitting the entry of flowable porcelain substance through said supply duct (164) into said mold and pressure space; and (cc) subsequently effecting a pressure increase in the space between said precompression die (140) and said precompression membrane (121) by activating said pressure fluid line (123) while maintaining said pressure chamber (114) in an essentially pressure free condition.

2. Mold and press unit, as set forth in claim 1, wherein said first mold and press unit can be displaced from the operating position relative to said second mold and press unit and can be moved into an operative position with respect to a third mold and press unit, so that articles formed between said first mold and press unit (110) and said second mold and press unit (130) can remain in said first mold and press unit (110) and can be completely pressed between said first mold and press unit (110) and said third mold and press unit by applying pressure in said pressure chamber (114).

3. Mold and press unit, as set forth in claim 1, wherein said supply duct (164) can be closed at the inlet end thereof into said mold and press space.

4. Mold and press unit, as set forth in claim 3, wherein a fluidizing air inlet tube (166) is located centered in said supply duct (164).

5. Mold and press unit, as set forth in claim 4, wherein a fluidizing air inlet tube (166) can be moved in the axial direction of said supply duct (164) for the purpose of closing said supply duct.

6. Mold and press unit, as set forth in claim 5, wherein said fluidizing air inlet tube (166) comprises a first tube and a second tube telescopically mounted relative to said first tube so that said second tube can be moved in the axial direction of said supply duct (164).

7. Mold and press unit, as set forth in claim 1, wherein said precompression membrane (121) extends over an annular surface of said precompression die and said annular surface is directed radially relative to the location of said supply duct extending through said (140).

8. Mold and press unit for producing molded articles from a dry, flowable porcelain substance, comprising a first mold and press mold (110) and a second mold and press unit (130), (a) said first mold press unit (110) and said second mold press unit (130) define a mold and press space (190) therebetween, said mold and press space having a circumferential edge encircling said mold and press space;

(b) said first mold press unit comprises a compression membrane (118) forming a part of said mold and press space and said compression membrane has an edge (120) extending radially outwardly from said mold and press space;

(c) said compression membrane (118) having one surface forming a part of said mold and press space and an opposite second surface and said first mold and press unit (110) includes a support plate (116) supporting the opposite second surface of said compression membrane;

(d) said support plate (116) having compressed medium channels (114') opening to the second surface of said compression membrane and a pressure chamber (114) in communication with the second surface of said compression membrane (118) through said channels so that pressure can be built up against the second surface;

(e) said second mold and press unit (130) includes a precompression die (140) located on the opposite side of said mold and press space from said compression membrane (118) and forming a part of said mold and press space;

(f) a first fluid-actuated power means (136) in communication with said precompression die (140) for pressing said die against said edge (120) of said compression membrane (118);

(g) said precompression die (140) having a supply duct (164) therethrough centrally arranged relative to said mold and press space for supplying flowable porcelain substance into said mold and press space, said supply duct secured to said precompression die;

(h) said second mold and press unit (130) includes suction means (117, 115, 184, 186) extending around the circumferential edge of said mold and press space and annularly around and spaced outwardly from said supply duct (198);

(i) an annular precompression membrane (121) located on the surface of said precompression die (140) facing said mold and press space, said precompression membrane (121) extending annularly around said supply duct (164) and extending outwardly therefrom toward the inlets (117) of said suction means (117, 115, 184, 186) into said mold and press space;

(j) a pressure fluid line (123) is connected to the space between said precompression die (140) and said precompression membrane (121);

(k) control means are provided for:

(aa) effecting contact pressure of said precompression die (140) on said edge (120) of said precompression membrane (118) by activating said first fluid actuating power means (136);

(bb) subsequently applying a vacuum at said suction means (117, 115, 184, 186) for permitting the entry of flowable porcelain substance through said supply duct (164) into said mold and pressure space; and (cc) subsequently effecting a pressure increase in the space between said precompression die (140) and said precompression membrane (121) by actuating said pressure fluid line (123) while maintaining said pressure chamber (114) in an essentially pressure free condition, said first mold and press unit can be displaced from the operating position relative to said second mold and press unit and can be moved into an operative position with respect to a third mold and press unit, so that articles formed between said first mold and press unit (110) and said second mold and press unit (130) can remain in said first mold and press unit (110) and can be completely pressed between said first mold and press unit (110) and said third mold and press unit by applying pressure in said pressure chamber (114).

9. Mold and press unit for producing molded articles from a dry, flowable porcelain substance, comprising a first mold and press unit (110) and a second mold and press unit (130), (a) said first mold press unit (110) and said second mold press unit (130) define a mold and press space (190) therebetween, said mold and press space having a circumferential edge encircling said mold and press space;

(b) said first mold press unit comprises a compression membrane (118) forming a part of said mold and press space and said compression membrane has an edge (120) extending radially outwardly from said mold and press space;

(c) said compression membrane (118) having one surface forming a part of said mold and press space and an opposite second surface, and said first mold and press unit (110) includes a support plate (116) supporting the opposite second surface of said compression membrane;

(d) said support plate (116) having compressed medium channels (114') opening to the second surface of said compression membrane and a pressure chamber (114) in communication with the second surface of said compression membrane (118) through said channels so that pressure can be built up against the second surface;

(e) said second mold and press unit (130) includes a precompression die (140) located on the opposite side of said mold and press space from said compression membrane (118) and forming a part of said mold and press space;

(f) a first fluid-actuated power means (136) in communication with said precompression die (140) for pressing said die against said edge (120) of said compression membrane (118);

(g) said precompression die (140) having a supply duct (164) therethrough centrally arranged relative to said mold and press space for supplying a flowable porcelain substance into said mold and press space, said supply duct secured to said precompression die;

(h) said second mold and press unit (130) includes suction means (117, 115, 184, 186) extending around the circumferential edge of said mold and press space and annularly around the spaced outwardly from said supply duct (198);

(i) an annular precompression membrane (121) located on the surface of said precompression die (140) facing said mold and press space, said precompression membrane (121) extending annularly around said supply duct (164) and extending outwardly therefrom toward the inlets (117) of said suction means (117, 115, 184, 186) into said mold and press space;

(j) a pressure fluid line (123) is connected to the space between said precompression die (140) and said precompression membrane (121);

(k) control means are provided for:

(aa) effecting contact pressure of said precompression die (140) on said edge (120) of said precompression membrane (118) by activating said first fluid actuating power means (136);

(bb) subsequently applying a vacuum at said suction means (117, 115, 184, 186) for permitting the entry of flowable porcelain substance through said supply duct (164) into said mold and pressure space; and (cc) subsequently effecting a pressure increase in the space between said precompression die (140) and said precompression membrane (121) by activating said pressure fluid line (123) while maintaining said pressure chamber (114) in an essentially pressure free condition, said first mold and press unit can be displaced from the operating position relative to said second mold and press unit and can be moved into an operative position with respect to a third mold and press unit, so that articles formed between said first mold and press unit (110) and second mold and press unit (130) can remain in said first mold and press unit (110) and can be completely pressed between said first mold and press unit (110) and said third mold and press unit by applying pressure in said pressure chamber (114) and said supply duct (164) can be closed at the inlet end thereof opening into said mold and pressed space, a fluidized air inlet tube (166) is located centered in said supply duct (164), said fluidized air inlet tube (166) can be moved in the axial direction of said supply duct (164) for the purpose of closing said supply duct.

* * * * *